US010126689B2

(12) United States Patent
Hamano et al.

(10) Patent No.: US 10,126,689 B2
(45) Date of Patent: Nov. 13, 2018

(54) IMAGE FORMING APPARATUS

(71) Applicant: CANON KABUSHIKI KAISHA, Tokyo (JP)

(72) Inventors: Akira Hamano, Kashiwa (JP); Koichi Taniguchi, Tokyo (JP); Daisuke Aruga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/603,839

(22) Filed: May 24, 2017

(65) Prior Publication Data

US 2017/0351206 A1 Dec. 7, 2017

(30) Foreign Application Priority Data

Jun. 2, 2016 (JP) ..... 2016-110825

(51) Int. Cl.
*G03G 15/043* (2006.01)
*G03G 15/20* (2006.01)

(52) U.S. Cl.
CPC ..... *G03G 15/2039* (2013.01); *G03G 15/043* (2013.01)

(58) Field of Classification Search
CPC ..... G03G 15/00; G03G 15/06; G03G 15/20; G03G 15/2039
See application file for complete search history.

(56) References Cited

U.S. PATENT DOCUMENTS 8,270,857 B2 * 9/2012 Saitou ..... G03G 15/0131 399/301
9,014,601 B2 * 4/2015 Sato ..... G03G 15/0189 399/301
2014/0064800 A1 * 3/2014 Sato ..... G03G 15/0189 399/301
2015/0301471 A1 10/2015 Nakahata et al.

FOREIGN PATENT DOCUMENTS

JP 2006-011289 A 1/2006

* cited by examiner

*Primary Examiner* — Huan Tran
(74) *Attorney, Agent, or Firm* — Fitzpatrick, Cella, Harper & Scinto

(57) ABSTRACT

Prediction accuracy of a color misregistration amount in an image formation executed in an image forming apparatus is improved. The image forming apparatus comprises an optical box storing an optical system for irradiating a laser beam from a laser source to a photosensitive drum, a scanner temperature sensor provided near the optical box, and an environmental temperature sensor for detecting a surrounding temperature of the image forming apparatus, and a control section. When image formation is executed, the control section obtains a temperature Tscn detected by the scanner temperature sensor and a temperature Tenv detected by the environmental temperature sensor and calculates a prediction value of a position misregistration amount to the photoreceptor of the laser beam using the difference between Tscn and Tenv.

10 Claims, 9 Drawing Sheets

IMAGE FORMING APPARATUS

BACKGROUND OF THE INVENTION

Field of the Invention

The present disclosure relates to an image forming apparatus such as a laser printer, a digital printer and the like.

Description of the Related Art

In an electrophotographic type color image forming apparatus, a method to provide an image forming section for each color of a transfer image to accelerate image forming processing to sequentially transfer an image of each color formed on a recording medium held on a conveyance belt in the image forming apparatus is proposed. Problems of the method include deformation and changes in position and posture of optical components such as a lens and a mirror due to heat generated from a deflector in a scanning optical device of the color image forming apparatus. As a result, an irradiation position of laser beam sometimes changes, which causes position misregistration when the image of each color is overlapped. This causes deviation of the irradiation position of the laser beam for each color, resulting in misregistration of an image forming position (hereinafter referred to as "color misregistration"). In Japanese Patent Application Laid-open No. 2006-011289, however, to suppress influence received by an air flow generated in the unit housing, the temperature sensor is arranged in a center part of the unit housing. Thereby, as compared to a case where temperature measurement is performed near a heat source, a variation amount in temperature is small. Thereby, as compared to a case where the temperature measurement is performed near the heat source in a state in which the variation amount in temperature is large, sensitivity to the temperature in controlling the position misregistration amount becomes high. As a result, a control error is easily caused.

To suppress the influence of the air flow as mentioned, it is considered that the temperature sensor is provided outside the unit housing to perform the correction as mentioned in accordance with the temperature detected by the temperature sensor. This is because, by providing the temperature sensor outside the unit housing, the influence of the air flow in the unit housing is no longer received.

In this case, however, an optical system is arranged in the unit housing whereas the temperature sensor is provided outside the unit housing. Thereby, a distance between the optical system and the temperature sensor becomes long so that the detected temperature detected by the temperature sensor does not sufficiently follow the temperature rise of the optical system. As a result, the temperature of the optical system cannot accurately be detected.

In a case where the temperature detected by the temperature sensor exceeds a predetermined temperature, previous correlation between the color misregistration amount and the detected temperature is no longer maintained. Thereby, it is difficult to obtain sufficient prediction accuracy with regard to the color misregistration amount using the correlation between the color misregistration and the detected temperature detected by the temperature sensor. Further, the predetermined temperature as mentioned is not constant, which makes it more difficult to obtain the sufficient prediction accuracy. Thereby, the present disclosure is intended to improve the prediction accuracy of the color misregistration amount.

SUMMARY OF THE INVENTION

An image forming apparatus according to the present disclosure includes an image forming apparatus comprising an image forming unit including a plurality of photosensitive members, an exposure device to expose each of the plurality of photosensitive members to form electrostatic latent images, and a developing device to develop the electrostatic latent images on the photosensitive member and configured to form images, each having a different color; a transfer member onto which the plurality of images formed by the image forming unit are transferred; a first temperature detection unit provided on a circuit board of the exposure device, and configured to detect a first temperature of the exposure device, the circuit board controlling a light source of the exposure device; a second temperature detection unit configured to detect a second temperature; a third temperature detection unit configured to detect a third temperature, wherein a distance between the third temperature detection unit and the first temperature detection unit is longer than a distance between the second temperature detection unit and the first temperature detection unit; a detection unit configured to detect a patch image formed on the transfer member, the patch image being used for detecting color misregistration; a controller configured to control the image forming unit to form, on the transfer member, a plurality of patch images, each having a different color, control the detection unit to detect an amount of color misregistration, related to a relative position of a patch image having a reference color among the plurality of patch images and a patch image having another color among the plurality of patch images; and a correction unit configured to correct an image write start timing of the other color different from the reference color based on the amount of color misregistration, the first temperature detected by the first temperature detection unit, and the second temperature detected by the second temperature detection unit, wherein the correction unit, in a case where a difference between the first temperature and the third temperature is greater than a threshold, corrects the image write start timing based on the amount of color misregistration and the second temperature without the first temperature.

Further features of the present invention will become apparent from the following description of exemplary embodiments (with reference to the attached drawings).

DESCRIPTION OF THE EMBODIMENTS

Figure 1:
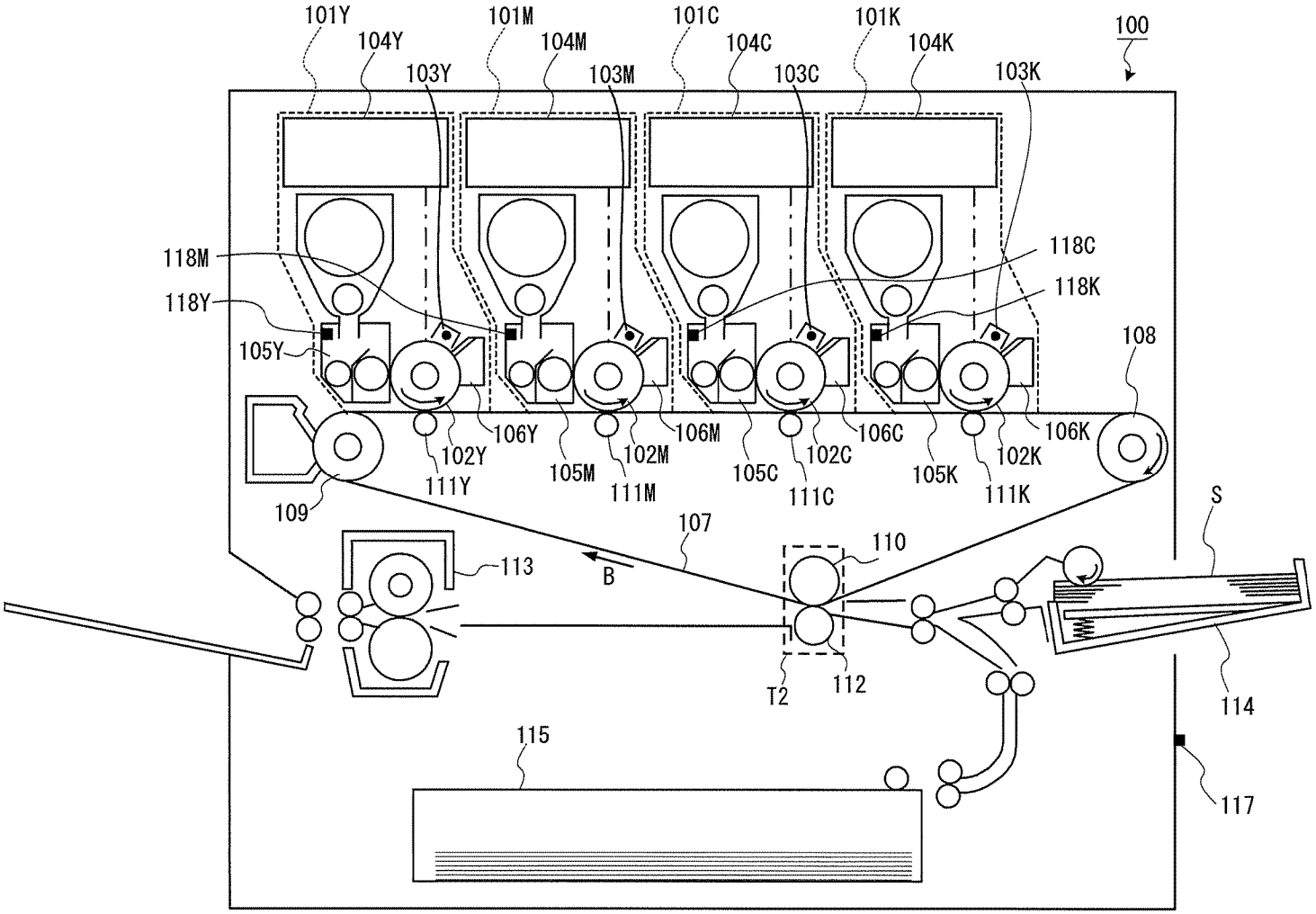
FIG. 1 is a schematic cross sectional view of a color printer.
Figure 2A:
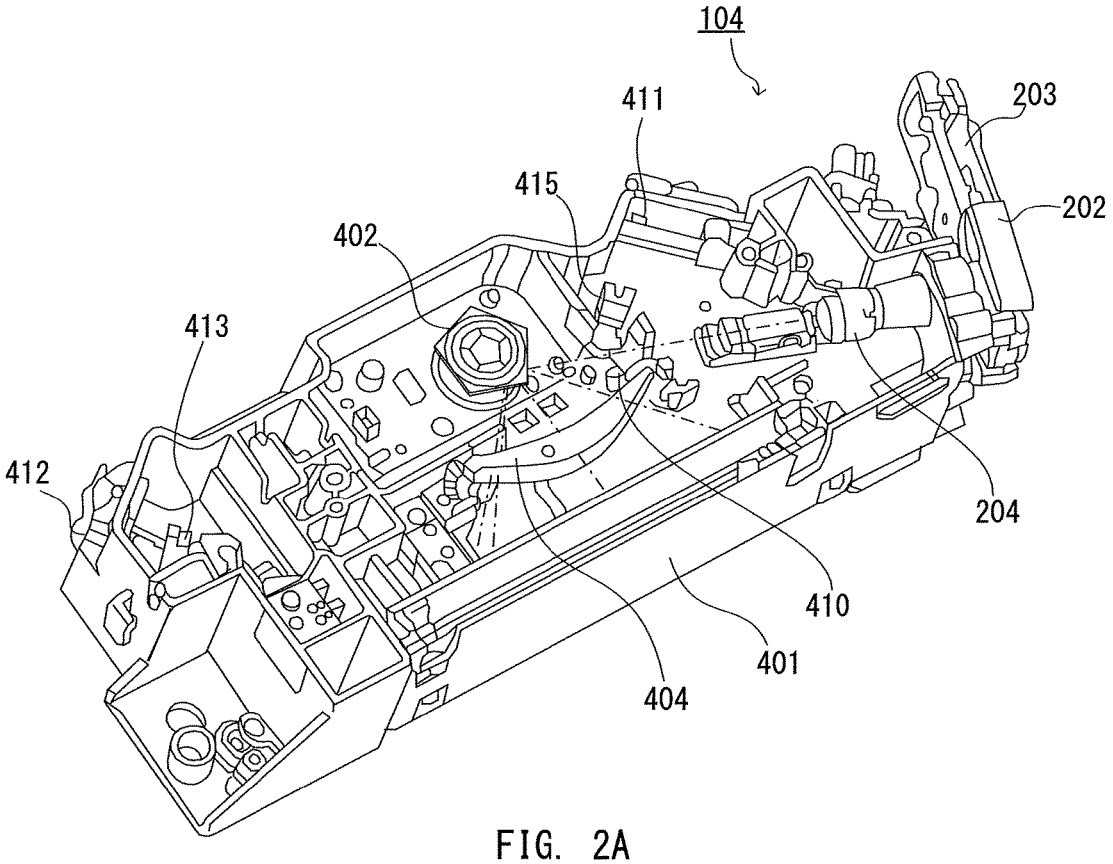
FIG. 2A is a perspective view of an optical unit.
Figure 2B:
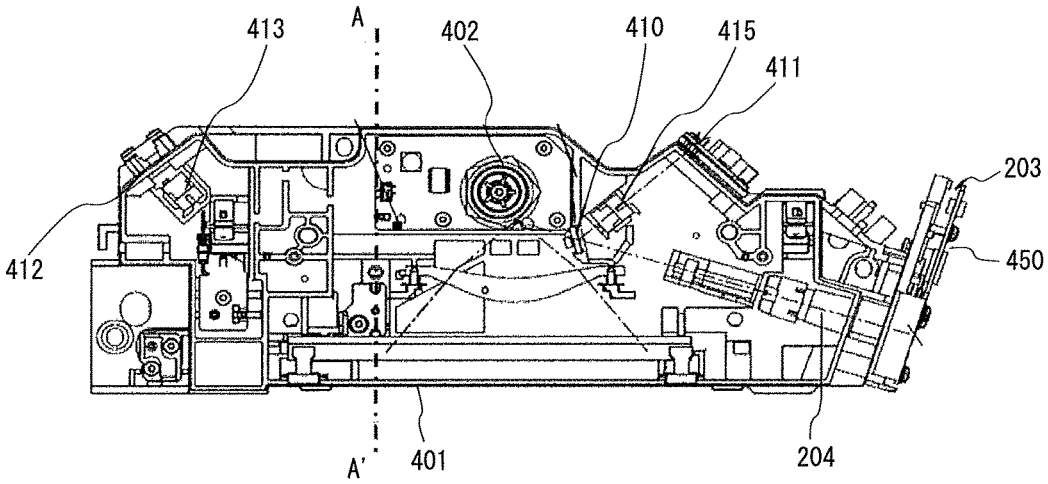
FIG. 2B is a top view of the optical unit.
Figure 2C:
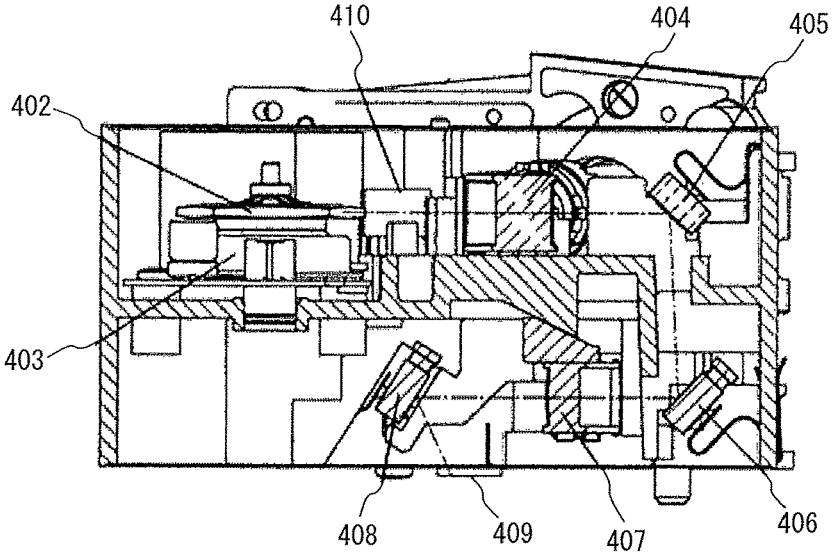
FIG. 2C is an A-A' cross sectional view of the optical unit.
Figure 2D:
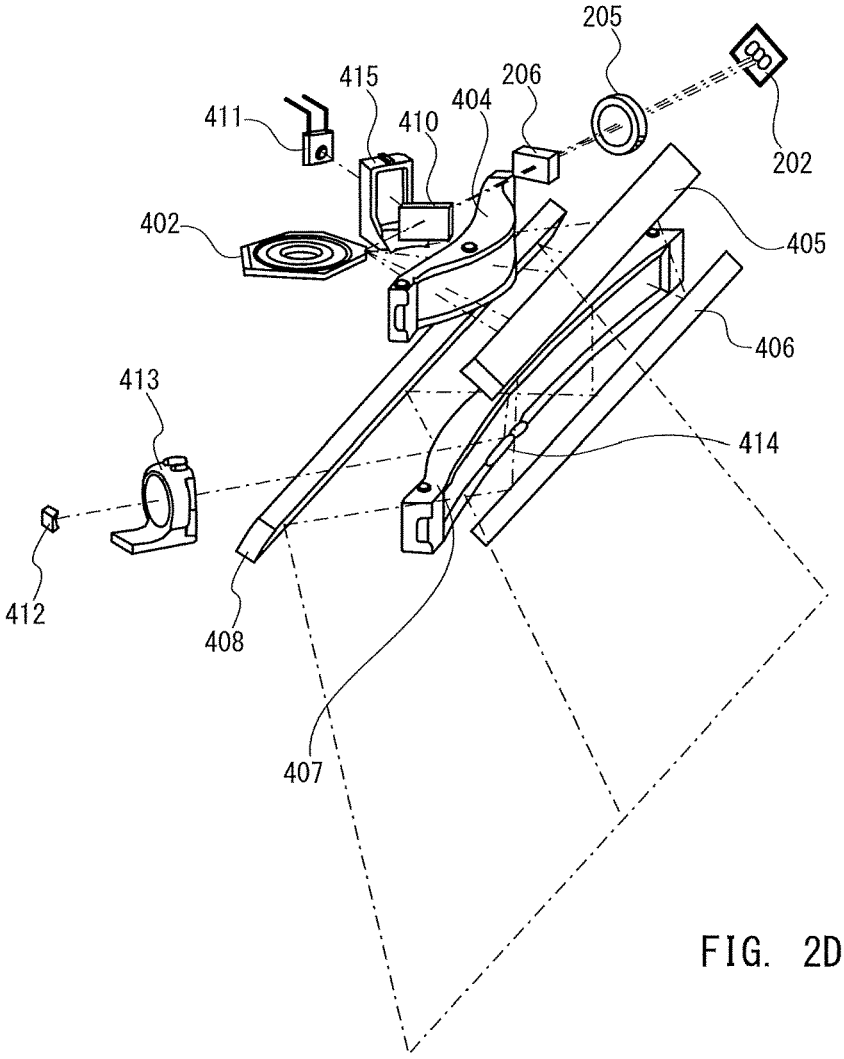
FIG. 2D is a partly disassembled perspective view of the optical unit.

In the following, a description is provided with regard to the image forming apparatus of the present embodiment with reference to FIGS. 1 to 5. FIG. 1 is a schematic cross sectional view of a digital full color printer as an image forming apparatus which performs color image formation using toner of a plurality of colors. FIG. 2A is a perspective view of a scanning optical device as a light beam emission apparatus provided in the digital full color printer shown in FIG. 1. Similarly, FIG. 2B is a top view of the scanning optical device. FIG. 2C is an A-A' cross sectional view of the scanning optical device. FIG. 2D is a partly disassembled perspective view of the scanning optical device.

The present disclosure explains a color image forming apparatus comprising the scanning optical device as an example. However, the present disclosure is not applied only to the color image forming apparatus and the scanning optical device provided therein. For example, the present disclosure can be applied to an image forming apparatus which forms an image only by a monochrome toner (for example, black) and the scanning optical device provided therein. It is noted that, in the case of a single color, no color misregistration is caused so that correction is performed to a magnification of the image.

First, a description is provided with regard to an image forming apparatus 100 of the present embodiment with reference to FIG. 1. The image forming apparatus 100 comprises four image forming sections 101 for forming an image of each color. The image forming sections 101Y, 101M, 101C, and 101K respectively use toner of yellow, magenta, cyan, and black to perform the image formation. Further, a photosensitive drum 102, a charging device 103, a scanning optical device (exposure device) 104, a developing device 105, a drum cleaning device 106, and a primary transfer device 111 corresponding to each color are arranged in the image forming apparatus 100. the photosensitive drum 102 corresponds to a photosensitive member.

In the following, as a representative example, a description is provided in detail with regard to the image forming section 101Y, a photosensitive drum 102Y for yellow and the like. The image forming section 101Y comprises the photosensitive drum 102Y having a layer of a photoreceptor (photosensitive layer). A charging device 103Y, a scanning optical device 104Y, and a developing device 105Y are provided around the photosensitive drum 102Y. A drum cleaning device 106Y for removing the toner adhering to the photosensitive drum 102Y is arranged in the image forming apparatus 101Y. A developing temperature sensor 118Y, provided in the developing device 105Y to perform temperature detection, detects a developing temperature which corresponds to the temperature of the image forming section 101Y. Similarly, a developing temperature sensor 118M is provided in a developing device 105M. A developing temperature sensor 118C is provided in a developing device 105C. A developing temperature sensor 118K is provided in a developing device 105K.

A belt-like intermediate transfer belt 107 as an intermediate transfer member is arranged below the photosensitive drum 102Y.

The intermediate transfer belt 107 is tensioned by a drive roller 108 and driven rollers 109 and 110. The intermediate transfer belt 107 carries the image and conveys the image in an arrow B direction. Further, a primary transfer device 111Y is provided via the intermediate transfer belt 107 at a position opposite to the photosensitive drum 102Y. An intermediate transfer unit includes the intermediate transfer belt 107, the drive roller 108, the driven roller 109, and the primary transfer device 111Y. The image forming apparatus 100 comprises a secondary transfer device 112 for transferring a toner image on the intermediate transfer belt 107 to a recording medium S and a fixing device 113 for fixing the toner image on the recording medium S. Further, the image forming apparatus 100 comprises an environmental temperature sensor 117 for detecting a temperature of a surrounding environment (environmental temperature) of the image forming apparatus 100.

Here, a description is provided with regard to an image forming process from a charging process to a developing process of the image forming apparatus 100 comprising the above mentioned configuration. The image forming process in each image forming section is the same. So, as to the image forming process, the image forming process for the image forming section 101Y is described as an example and the description with regard to the image forming sections 101M, 101C, and 101K is omitted.

First, the photosensitive drum 102Y which is rotationally driven is charged by the charging device of the image forming section 101Y. The charged photosensitive drum 102Y is exposed by the laser beam emitted from the scanning optical device 104Y. With this, an electrostatic latent image is formed on a rotating photosensitive drum 102Y. Thereafter, the electrostatic latent image is developed by the developing device 105Y as a yellow toner image.

In the following, a description is provided with regard to the image forming process after a secondary transfer process with the image forming section as an example. A transfer bias is applied to the transfer belt by the primary transfer device 111Y. Then, a yellow toner image is formed on the photosensitive drum 102Y of each image forming section. Similarly, with regard to the rest of the colors, the toner image of the respective colors is formed. These toner images are respectively transferred to the intermediate transfer belt 107 and the toner image of each color is overlapped on the intermediate transfer belt 107.

When the toner image of the four colors is transferred to the intermediate transfer belt 107, the toner image of the four colors transferred to the intermediate transfer belt 107 is transferred again to the recording medium S by the secondary transfer device 112 (secondary transfer). At this time, the recording medium S is conveyed to a secondary transfer part T2 from a manual sheet feeding cassette 114 or a sheet feeding cassette 115. Then, the secondary transfer as mentioned is performed. By heating to fix the toner image formed on the recording medium S by the secondary transfer with the fixing device 113, a full-color image is obtained on the recording medium S. The recording medium S is delivered to a delivery section after the toner image is heated and fixed.

It is noted that residual toner removal is performed by the drum cleaning device 106Y to the photosensitive drum 102Y which finishes the transfer. Thereafter, the image forming process as mentioned is continuously performed.

As shown in FIG. 2A and FIG. 2B, a vertical cavity surface emitting laser (hereinafter described as "VCSEL") 202, which is a laser light source, is stored in an optical box 401. The VCSEL 202 includes a plurality of light emitting elements. Further, a board 203 and an optical system are stored in the optical box 401. The board 203 is an electric board for driving the VCSEL 202. The optical system images the laser beam emitted from the VCSEL 202 to the photosensitive drums 102Y, 102M, 102C, and 102K corresponding to each color respectively. The optical system includes a deflection part 204 and a rotating polygon mirror 402. The rotating polygon mirror 402 deflects the laser beam such that it scans the photosensitive drums 102Y, 102M, 102C, and 102K of each color in a predetermined direction.

In the following, a description is provided with regard to the rotating polygon mirror 402 with mainly reference to FIG. 2C and FIG. 2D. The rotating polygon mirror 402 is rotationally driven by a motor 403. The laser beam deflected by the rotating polygon mirror 402 enters a first fθ lens 404. The laser beam which passes the first fθ lens 404 is reflected by a reflection mirror 405 and a reflection mirror 406 and enters a second fθ lens 407.

The laser beam which passes the second fθ lens 407 is reflected by a reflection mirror 408, passes a dustproof glass 409 and is guided on the photosensitive drum. With the above configuration, the laser beam which is scanned by the rotating polygon mirror 402 at equal angular velocity is imaged on the photosensitive drums 102Y, 102M, 102C, and 102K through the first fθ lens 404 and the second fθ lens 407. The laser light scans the photosensitive drums at equal speed.

Further, in the scanning optical device 104 of the present embodiment, as shown in FIG. 2D, the laser beam emitted from the VCSEL 202 goes toward the rotating polygon mirror 402 through a collimator lens 205 and a cylindrical lens 206.

A beam splitter 410 is arranged on an optical path of the laser beam emitted from the optical unit 200. Due to this, the laser beam which enters the beam splitter 410 is separated into first laser beam which is transmitted light and second laser beam which is reflected light. The first laser beam is deflected by the rotating polygon mirror 402 and guided on the photosensitive drum as mentioned. After passing a condensing lens 415, the second laser beam enters a photodiode 411 (hereinafter described as "PD 411") which is a photoelectric conversion element (light receiving part). The PD 411 outputs a detection signal in accordance with a received light amount. Based on the output detection signal, automatic power control (APC) which is described later is performed.

Further, the scanning optical device 104 of the present embodiment comprises a beam detector (BD) 412. The beam detector 412 generates a synchronization signal for determining emission timing of the laser beam on each of the photosensitive drums 102Y, 102M, 102C, and 102K based on image data. The laser beam deflected by the rotating polygon mirror 402 (first laser beam) passes the first fθ lens 404, is reflected by the reflection mirror 405 and a mirror 414 shown in FIG. 2D, and enters the beam detector 412. The laser beam which enters the beam detector 412 passes an optical system 413 having a plurality of lenses and enters the beam detector 412.

As shown in FIG. 2B, a scanner temperature sensor 450, provided outside and near the optical box 401, is provided on the board 203. The scanner temperature sensor 450 detects the temperature inside the optical box 401. By feeding back the detection result of the scanner temperature sensor 450, a CPU 501 corrects a change of the image forming position caused by a change of the temperature inside the optical box 401.

For example, the CPU 501 corrects relative position misregistration (color misregistration amount) between a magenta image and an image other than the magenta. To correct the relative position misregistration between an image having a reference color and an image having another color, for example, the CPU 501 controls exposure timing of the laser beam emitted from the VCSEL 202.

Here, the scanner temperature sensor 450 is provided on the board 203 provided outside the optical box 401. However, for example, the board 203 may be provided inside the optical box 401 and the scanner temperature sensor 450 may be provided on the board 203.

Figure 3:
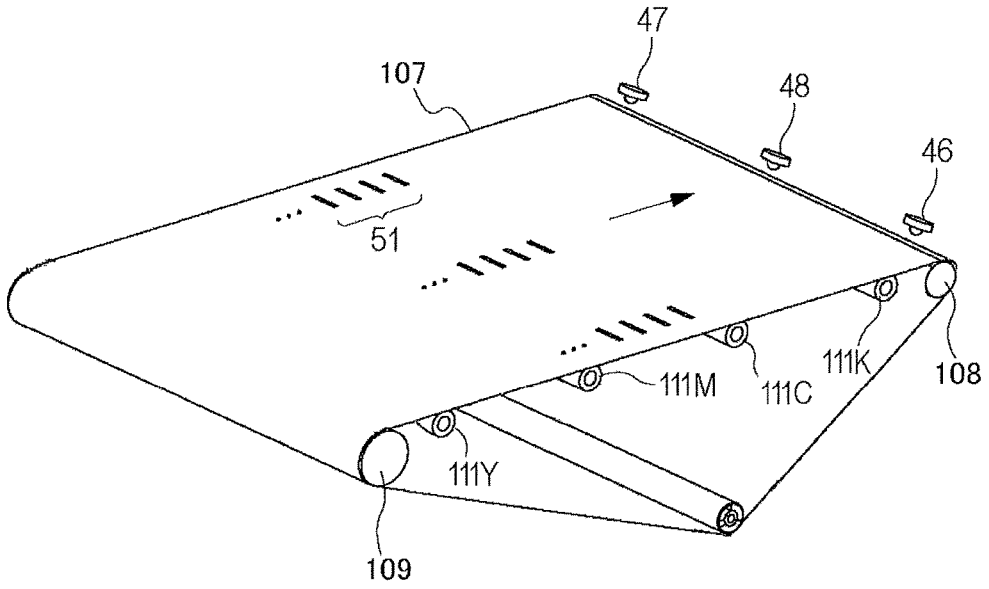
FIG. 3 is an explanatory diagram of a sensor and a detection patch.

FIG. 3 shows a schematic view of sensors 46, 47, and 48 provided near the intermediate transfer belt 107 and a detection patch 51. The sensors 46, 47, and are optical sensors. Detection positions of the sensors 46, 47, and 48 are different in a direction which is orthogonal to a conveying direction to which the intermediate transfer belt 107 conveys the detection patch 51. The sensors 46, 47, and 48 detect a relative position of detection patches 51Y, 51M, 51C, and 51K in the conveying direction of the intermediate transfer belt 107.

Figure 4:
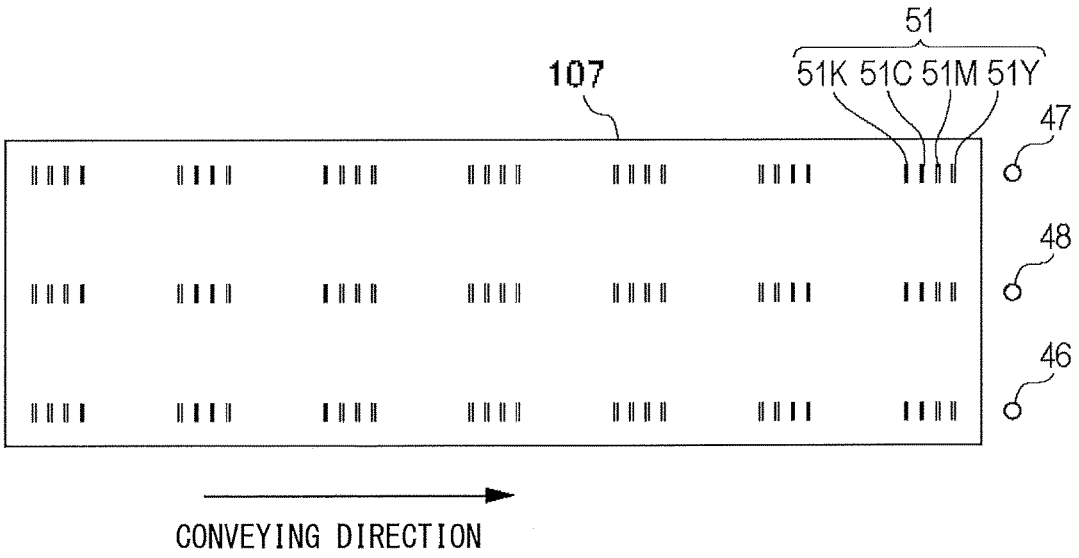
FIG. 4 is a schematic view of the detection patch.

FIG. 4 is a schematic view of the detection patches 51Y, 51M, 51C, and 51K formed on the intermediate transfer belt 107. The detection patch 51Y corresponds to a yellow detection patch. The detection patch 51M corresponds to a magenta detection patch. The detection patch 51C corresponds to a cyan detection patch. The detection patch 51K corresponds to a black detection patch. The detection patches 51Y, 51M, 51C, and 51K are formed to detect the color misregistration amount in the conveying direction of the intermediate transfer belt 107. It is noted that the conveying direction corresponds to a direction which is orthogonal to a scanning direction of the laser beam.

Figure 5:
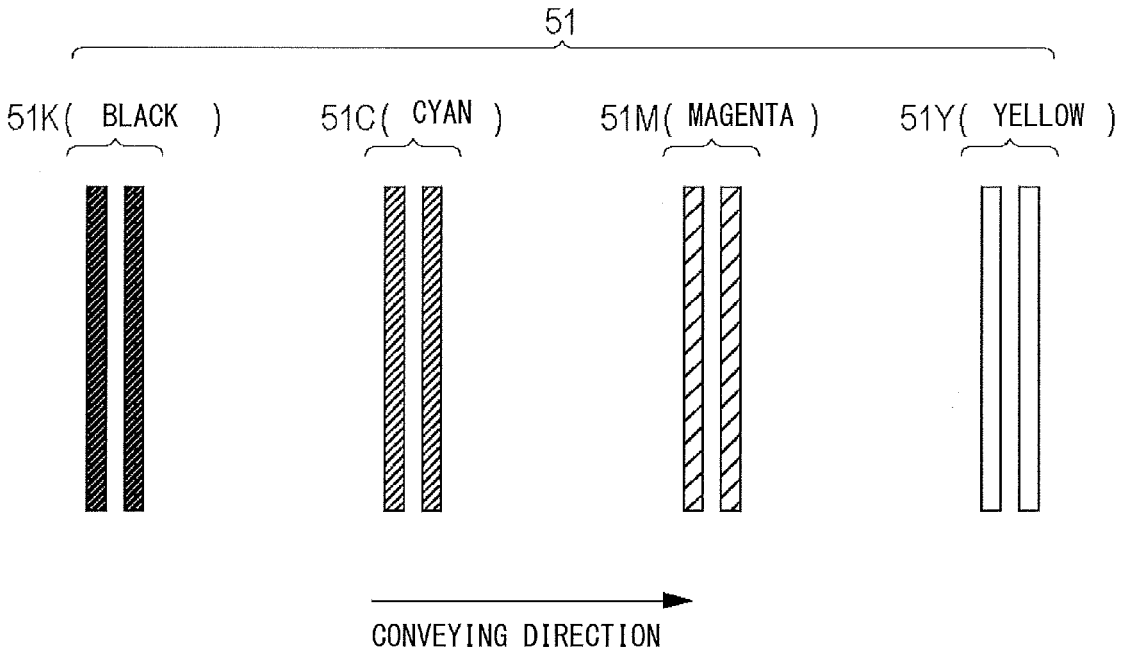
FIG. 5 is an enlarged view of the detection patch.

FIG. 5 shows an enlarged view of the detection patches 51Y, 51M, 51C, and 51M. As shown in FIG. 5, the detection patch 51Y includes two patches which are formed at fixed intervals. By comparing a detection result of the two patches, the detection patch 51Y prevents misdetection of dusts and foreign matters.

Each shape of the detection patches 51Y, 51M, 51C, and 51K is not limited to a horizontal line shape as shown in FIG. 4 and FIG. 5 but it may be a shape such as a vertical line, a cross line, a triangle line shape, and the like. The detection patches 51Y, 51M, 51C, and 51K shown in FIG. 4 and FIG. 5 are detected by the sensors 46, 47, and 48.

The CPU 501 determines a color misregistration correction amount for yellow based on a measurement result of the detection patches 51M and 51Y such that a deviation of the image forming position of a measurement image for yellow to the measurement image for magenta becomes a predetermined value. Similarly, the CPU 501 determines the color misregistration correction amount for cyan based on a measurement result of the detection patches 51M and 51C such that a deviation of the image forming position of the measurement image for cyan to the measurement image for magenta becomes a predetermined value. The CPU 501 determines the color misregistration correction amount for black based on a measurement result of the detection patches 51M and 51K such that a deviation of the image forming position of the measurement image for black to the measurement image for magenta becomes a predetermined value. It is noted that a method to determine the color misregistration correction amount for each color is well known so that its description is omitted.

Figure 6:
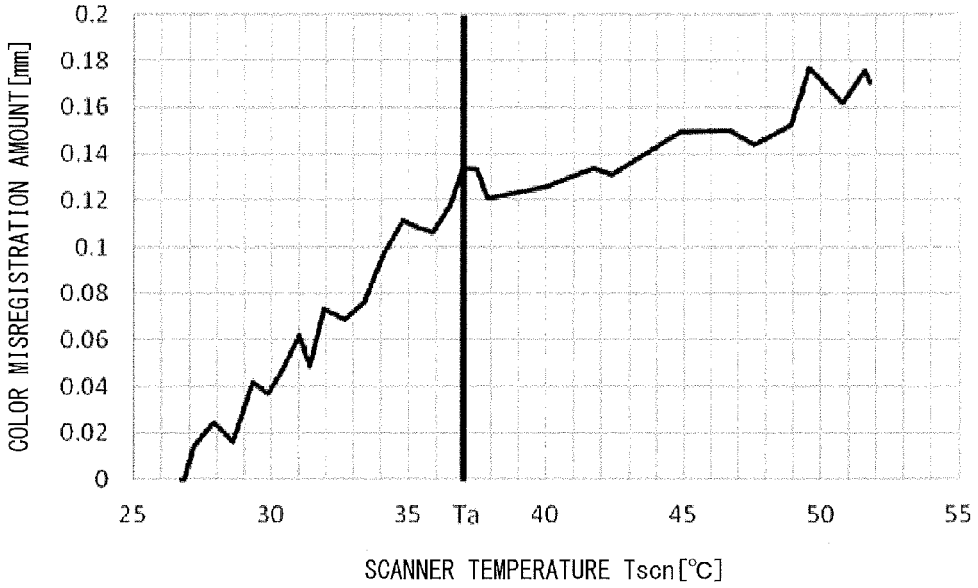
FIG. 6 is a graph showing relation of a scanner temperature value and a color misregistration amount D.

Here, FIG. 6 shows an experiment result indicating relation of a detected temperature of the scanner temperature sensor and an actual measurement value of the color misregistration amount of the image forming section 101Y for yellow. In FIG. 6, a longitudinal axis represents a color misregistration amount D mm and a lateral axis represents a scanner temperature Tscn° C.

A variation amount of the color misregistration amount to the variation of the scanner temperature in a region where the scanner temperature Tscn is at a boundary temperature Ta or below is larger than the variation amount of the color misregistration amount to the variation of the scanner temperature in a region where the scanner temperature Tscn exceeds the boundary temperature Ta. It is considered that, due to a self temperature rise of the board 203, the scanner temperature Tscn detected by the scanner temperature sensor 450 rises so that the scanner temperature Tscn detected by the scanner temperature sensor 450 becomes higher than the temperature inside the optical box 401. Thereby, in the present disclosure, a condition to calculate the color misregistration amount in a case where the scanner temperature Tscn is at the boundary temperature Ta or below is different from that in a case where the scanner temperature Tscn is higher than the boundary temperature Ta.

Further, it has been found by the experiment that the boundary temperature Ta is influenced by the environmental temperature where the image forming apparatus 100 is installed. It means that the higher the environmental temperature is, the higher the boundary temperature Ta becomes. Thereby, to predict the color misregistration amount, not only the scanner temperature Tscn, but an environmental temperature Tenv needs to be used.

Figure 7:
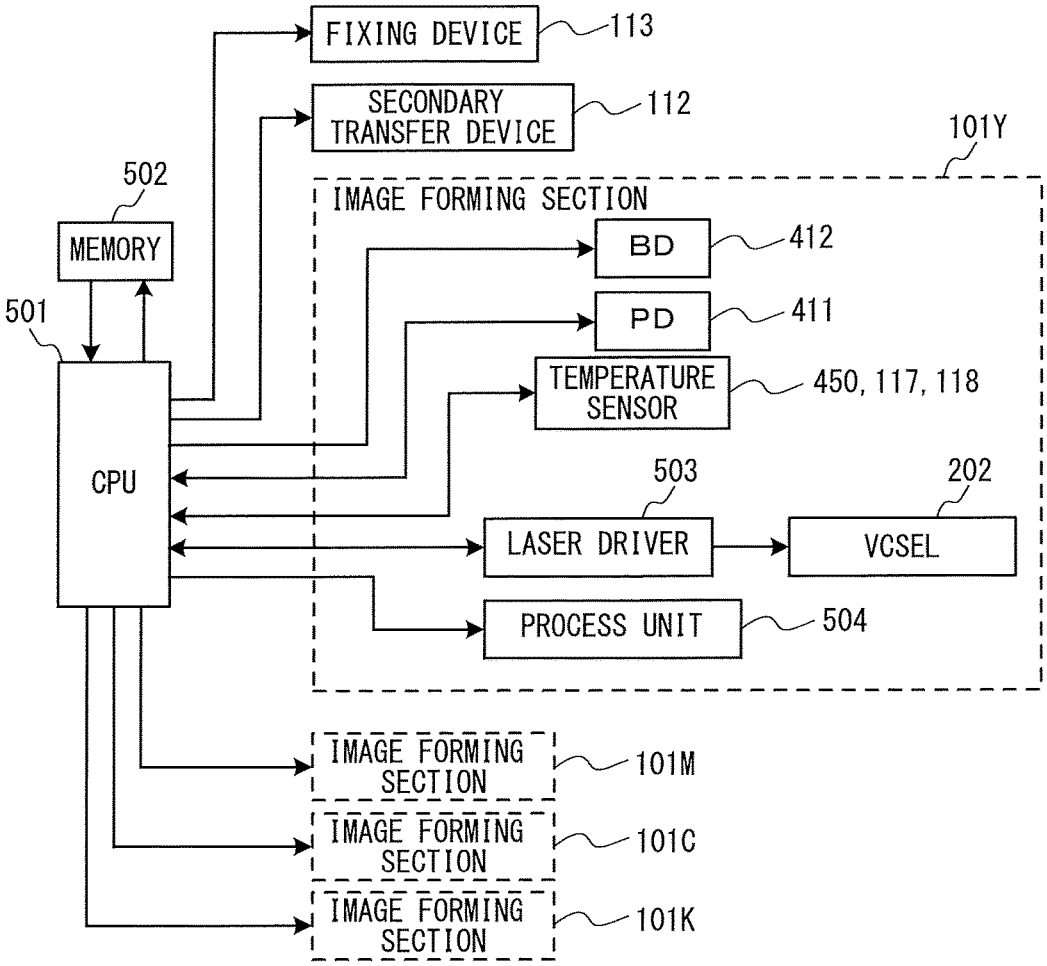
FIG. 7 is a control block diagram of the image forming apparatus.

FIG. 7 is a control block diagram of the image forming apparatus 100. It is noted that, in FIG. 7, each unit of the image forming sections 101M, 101C, and 101K is identical to that of the image forming section 101Y. So, in the following, a description with regard to the image forming sections 101M, 101C and 101K is omitted.

The CPU 501 is a control section for controlling each element based on a control program stored in a memory 502. A process unit 504 shown in FIG. 7 collectively refers to a driving part which drives the photosensitive drum 102Y, the charging device 103Y, the developing device 105, the drum cleaning device 106Y, the drive roller 108, and the primary transfer device 111Y. Further, the CPU 501 controls the secondary transfer device 112 and the fixing device 113 for fixing the toner image on the recording medium S such that printing processing is normally executed.

Not only the control program but also timing data which defines emission timing of each light emitting element of the VCSEL 202 and correction data of the color misregistration amount D are stored in the memory 502. The CPU 501 incorporates a clock signal generation section such as a crystal oscillator which generates a higher frequency clock signal than the synchronization signal and a counter which counts the clock signal.

The synchronization signal which is output from the beam detector 412 and the detection signal which is output from the PD 411 are input to the CPU 501. Further, the detection signals output from the environmental temperature sensor 117, the developing temperature sensors 118Y, 118M, 118C, and 118K, and the scanner temperature sensor 450 (hereinafter collectively referred to "temperature sensor") are input to the CPU 501. It is noted that a distance between the environmental temperature sensor 117 and the developing temperature sensor 118Y is farther than a distance between the scanner temperature sensor 450 and the developing temperature sensor 118Y. This applies to the developing temperature sensors 118M, 118C, and 118K. Based on the synchronization signal, the CPU 501 transmits a control signal to a laser driver 503. Based on the control signal, the laser driver 503 transmits a driving signal to the VCSEL 202. Based on the signal from the temperature sensor, the CPU 501 predicts the color misregistration amount D to control the driving signal transferred to the VCSEL 202. Due to this, the image forming position of the image having the other color is corrected such that the image forming position of the image of the reference color becomes equal to the image forming position of the image having the other color. It means that the color misregistration of the image of each color is reduced.

In the following, with reference to an explanatory diagram of the synchronization signal and the driving signal, a description is provided with regard to control executed in one scanning period of the laser beam in the present embodiment.

Figure 8:
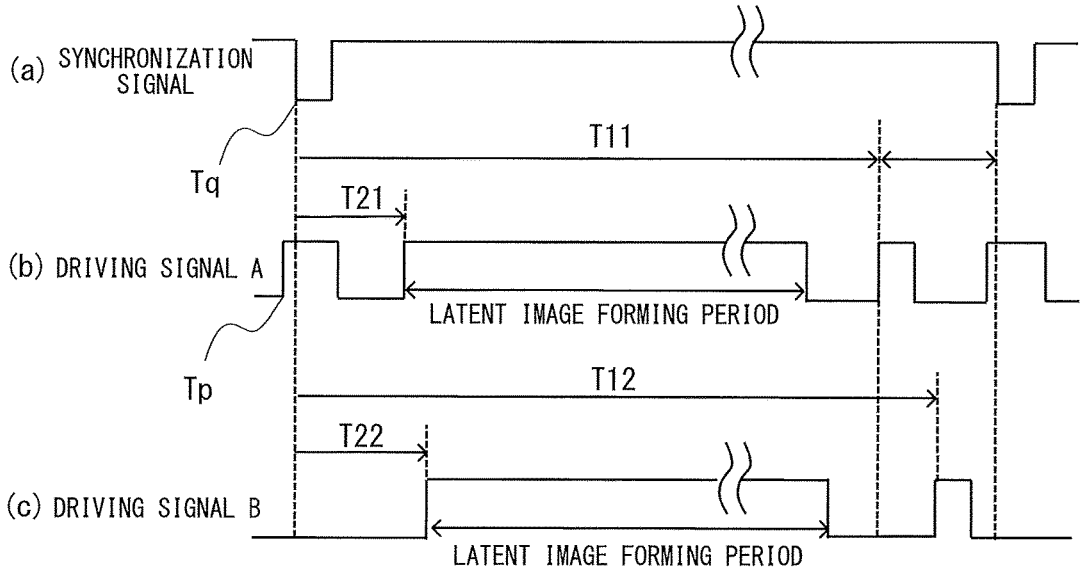
FIG. 8 is an explanatory diagram of a synchronization signal and a driving signal.

In FIG. 8, the synchronization signal is the output signal from the beam detector 412. The driving signal A is transmitted from the laser driver 503 to a first light emitting element out of each light emitting element of the VCSEL 202. Further, a driving signal B is transmitted to a second light emitting element from the laser driver 503 out of a plurality of light emitting elements of the VCSEL 202. It is noted that, to simplify the description, two light emitting elements are used in this example, however, more than three light emitting elements may be used.

When a signal value which is output from the beam detector 412 turns Low from High, a beam detector signal is generated. Then, using timing at which the beam detector signal is generated as a standard, the driving signal A is synchronized with the driving signal B. This timing is shown by Tq in (a) in FIG. 8.

Here, to output the beam detector signal from the beam detector 412, the laser beam needs to be made incident to the beam detector 412 from the first light emitting element. To this end, as shown in (a) in FIG. 8, to cause the beam detector 412 to generate the synchronization signal, the laser driver 503 turns the signal value of the first light emitting element from Low to High and transmits the driving signal to the beam detector 412.

The beam detector 412 outputs the synchronization signal after the laser beam is made incident to the beam detector 412. Thereby, it is required to transmit the driving signal in accordance with timing at which the laser beam emitted from the first light emitting element is made incident to the beam detector 412. Due to this, the laser beam is emitted from the first light emitting element at timing Tp which is faster than Tq. Then, the beam detector 412 which receives the laser beam generates the beam detector signal.

Based on the generation timing Tq of the synchronization signal, the CPU 501 determines an exposure start position (image forming start position) of a main scanning direction. Further, in response to the generation of the synchronization signal, the CPU 501 starts to count with the counter. Then, when a count value reaches a latent image forming start count value which corresponds to latent image forming start time set to correspond to each light emitting element, the CPU 501 causes the laser driver 503 to start emitting the laser beam based on the image data.

As shown in (b) in FIG. 8, the CPU 501 detects that the count value reaches the latent image forming start count value which corresponds to latent image forming start time T21 after the synchronization signal is generated. In response to this, to form the toner image on the photosensitive drum, the CPU 501 causes the laser driver 503 to control the first light emitting element to emit the laser beam.

Similarly, the CPU 501 detects that the count value reaches the latent image forming start count value which corresponds to latent image forming start time T22 after the synchronization signal is generated. In response to this, to form the toner image on the photosensitive drum, the CPU 501 causes the laser driver 503 to emit the laser beam from the second light emitting element.

Thereafter, during the latent image forming period shown in (b) and (c) in FIG. 8, the laser beam based on the image data is respectively emitted from each light emitting element.

Further, in response to the generation of the synchronization signal, the CPU 501 resets the count value of the counter and starts counting. Then, in response to the fact that the count value reaches the value corresponding to auto power control (APC) start time set to correspond to each light emitting element, the CPU 501 separately lights each light emitting element of the VCSEL 202. Thereafter, based on the light receiving result obtained by receiving the laser beam emitted from each light emitting element, the CPU 501 executes the APC of each light emitting element.

It means that the CPU 501 executes the APC after predetermined times T11 and T12 which correspond to the APC start time after the synchronization signal is generated.

It is noted that the latent image forming start time and the APC start time set to correspond to each light emitting element are set based on incident timing of the laser beam, scanned on the rotating polygon mirror considering the rotation speed of the rotating polygon mirror, to the beam detector 412 and the PD 411. In addition, in the above, the latent image forming start time and the APC start time have been described as the values individually set to correspond to each light emitting element. However, the latent image forming start time and the APC start time may be predetermined values which are set in common with each light emitting element.

The CPU 501 compares a voltage of the detection signal which is output from the PD 411 with a reference voltage which corresponds to a target light amount (which corresponds to reference data stored in the memory 502). Then, the CPU 501 controls a driving current value which is a driving signal to be supplied to each light emitting element based on difference in the voltages.

It means that in a case where the voltage of the detection signal which is output from the PD 411 is lower than the voltage which corresponds to the target light amount, the driving current to be supplied to the light emitting element is increased to increase the light amount of the laser beam. On the other hand, in a case where the voltage of the detection signal which is output from the PD 411 is higher than the voltage which corresponds to the target light amount, the current to be supplied to the light emitting element from the laser driver 503 is decreased to decrease the light amount of the laser beam.

First Embodiment

In the following, a description is provided with regard to calculation flow of a prediction value in the first embodiment using a temperature measured by the developing temperature sensor 118Y provided in the image forming section 101Y and a temperature measured by the environmental temperature sensor 117. The CPU 501 obtains a measured value of the developing temperature sensor 118Y, the scanner temperature sensor 450, and the environmental temperature sensor 117 to store the measured values in the memory 502. Every time the image for one page is formed, the CPU 501 calculates a prediction value Dx of the color misregistration amount D from the measured value of the developing temperature sensor 118Y, the scanner temperature sensor 450, and the environmental temperature sensor 117. These measured values become correction information for correcting the color misregistration amount D.

Figure 9:
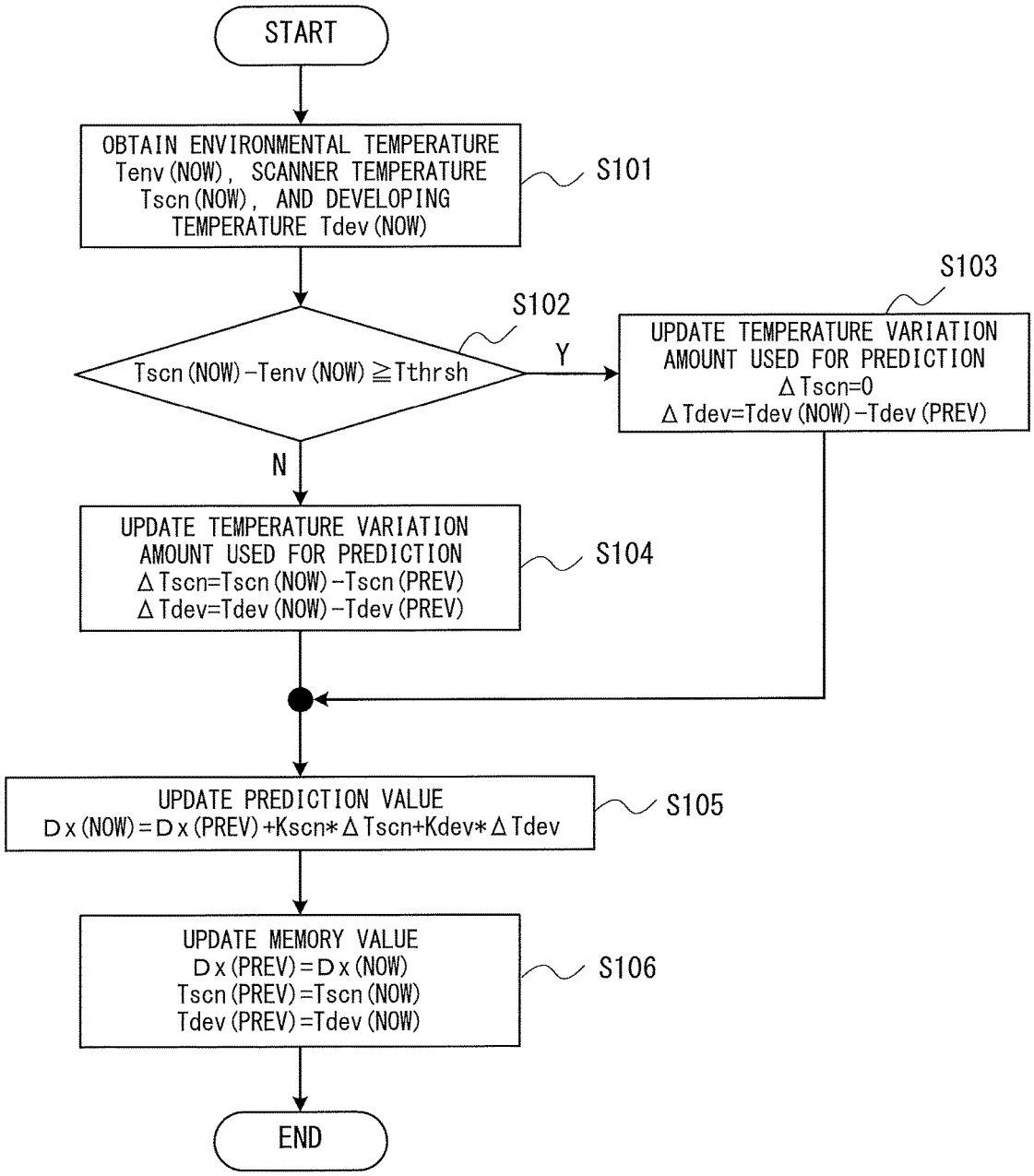
FIG. 9 is a flow chart for color misregistration prediction value calculation.

FIG. 9 is a flowchart for predictive calculation of the prediction value Dx after the printing processing is started. Here, Tscn represents a detected temperature of the scanner temperature sensor 450. Tenv represents a detected temperature of the environmental temperature sensor 117. Tdev represents a detected temperature of the developing temperature sensor 118Y.

In FIG. 9, a suffix (NOW) indicates that it is the latest temperature information obtained by each temperature sensor. Also, a suffix (PREV) indicates that the value is the temperature information previously obtained. A symbol Δ shows the variation amount from the previous measurement. Thereby, ΔTscn represents the variation amount of the detection value in the scanner temperature sensor 450, i.e., ΔTscn represents Tscn(NOW)−Tscn(PREV). Similarly, ΔTdev represents the variation amount of the detection value in the scanner temperature sensor 450, i.e., ΔTdev represents Tdev(NOW)−Tdev(PREV).

Further, as mentioned, the prediction value Dx shows a displacement amount from the reference position at the image forming position. Further, Tthrsh represents temperature threshold. Kscn and Kdev respectively represent a correction coefficient of a predictive expression.

The CPU 501 executes each processing in this flowchart. In the following, a description is provided with regard to specific contents of the flowchart.

In a case where the image data for one page is transferred, before the electrostatic latent image formation is started, the CPU 501 obtains an environmental temperature Tenv (NOW), a scanner temperature Tscn(NOW), and a developing temperature Tdev(NOW) (Step S101). Then, the CPU 501 determines whether difference between the scanner temperature Tscn(NOW) and the environmental temperature Tenv(NOW) is equal to or more than threshold Tthrsh or not (Step S102).

In a case where it is determined that the difference is equal to or more than the threshold Tthrsh (Step S102: Y), the CPU 501 updates the temperature variation amount used for the prediction as expressions as follows (Step S103).

$$\Delta Tscn=0 \tag{1}$$

$$\Delta Tdev=Tdev(NOW)-Tdev(PREV) \tag{2}$$

In a case where it is determined that the difference is less than the threshold Tthrsh (Step S102: N), the CPU 501 updates the temperature variation amount used for the prediction in accordance with following expressions (Step S104).

$$\Delta Tscn=Tscn(NOW)-Tscn(PREV) \tag{3}$$

$$\Delta Tdev=Tdev(NOW)-Tdev(PREV) \tag{4}$$

Figure 10:
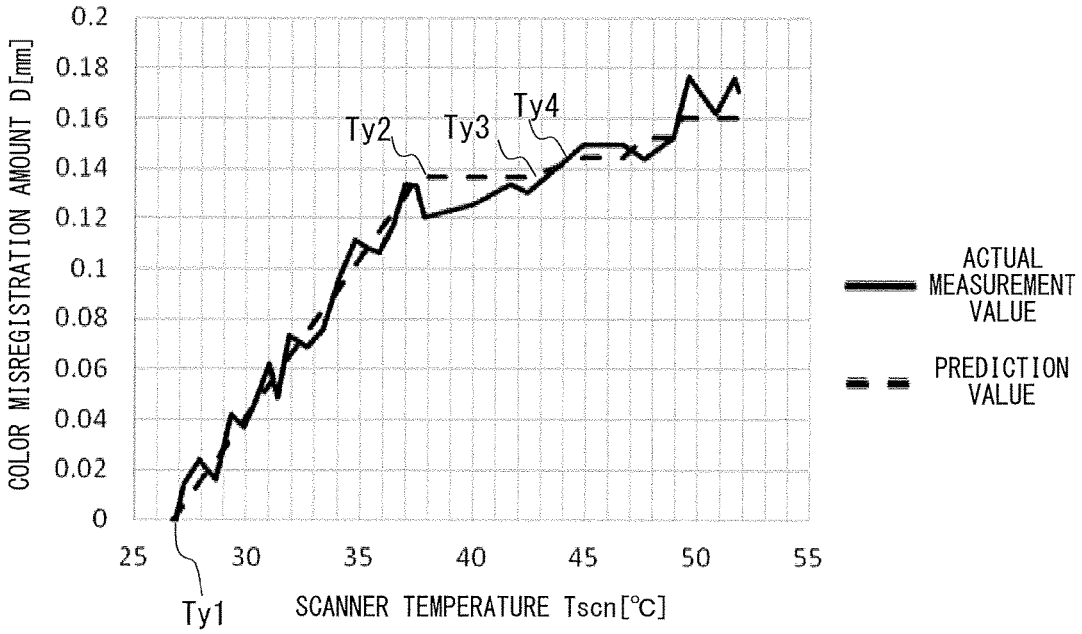
FIG. 10 is a graph comparing a color misregistration prediction value and an actual measurement value.

As mentioned, the boundary temperature Ta varies depending on a set environmental temperature and does not take a constant value. Thereby, the CPU 501 compares the difference between the scanner temperature Tscn and the environmental temperature Tenv with the threshold Tthrsh. By setting the temperature in which the difference between the scanner temperature Tscn(NOW) and the environmental temperature Tenv(NOW) becomes the threshold Tthrsh as the boundary temperature Ta, it is possible to obtain the prediction value Dx with more accuracy. As shown in FIGS. 6 and 10, a proportional constant of the color misregistration amount D to the scanner temperature Tscn changes with the threshold Tthrsh as a boundary. In this embodiment, as shown in the expression (1), in a case where the value obtained by Tscn(NOW)−Tenv(NOW) exceeds the threshold Tthrsh, the value of the ΔTscn, which is the temperature variation amount of the scanner temperature ΔTscn, is set to 0 (zero). Thereby, the color misregistration caused by an excessive correction of the temperature of the scanner temperature Tscn is suppressed, which improves the color misregistration prediction accuracy.

Next, based on the temperature variation amount obtained in the Steps S103 and S104 and a previous prediction value Dx(PREV), the CPU 501 obtains a prediction value Dx(NOW) as follows (Step S105).

$$Dx(\mathrm{NOW})=Dx(\mathrm{PREV})+\mathrm{Kscn}*\Delta\mathrm{Tscn}+\mathrm{Kdev}*\Delta\mathrm{Tdev} \quad (5)$$

Lastly, the CPU 501 updates the temperature information (Step S106) and ends the flow. In particular, the CPU 501 updates the information in accordance with the following expressions.

$$Dx(\mathrm{PREV})=Dx(\mathrm{NOW})$$

$$\mathrm{Tscn(PREV)=Tscn(NOW)}$$

$$\mathrm{Tdev(PREV)=Tdev(NOW)}$$

As mentioned, by obtaining the difference between the temperature Tscn(NOW) measured by the scanner temperature sensor 450 and the temperature Tenv(NOW) measured by the environmental temperature sensor 117 and using ΔTscn calculated in accordance with the difference, it is possible to predict the color misregistration amount D with more accuracy.

Further, as the color misregistration amount D is influenced by the developing temperature Tdev(NOW), by predicting the color misregistration amount D by additionally using Tdev(NOW), it is possible to further improve the prediction accuracy.

In particular, in a case where the difference between the scanner temperature Tscn(NOW) and the environmental temperature Tenv(NOW) is larger than the threshold Tthrsh, by setting ΔTscn to "0" (zero) regardless of its actual value, prediction accuracy improvement is achieved. As mentioned, in FIG. 6, an inclination of a graph is changed in a region where the scanner temperature is at the boundary temperature Ta or below and in a region where the scanner temperature exceeds the boundary temperature Ta. In a case where the threshold Tthrsh is larger than predetermined threshold, by setting ΔTscn to "0" regardless of its actual value, the change of the inclination of the graph is reflected so that the prediction value Dx(NOW) of the color misregistration amount D can be obtained. Due to this, it becomes possible to more accurately obtain the prediction value Dx(NOW).

By correcting the emission timing of the laser beam to the photosensitive drum 102Y using the color misregistration amount D as obtained in this manner or the prediction value Dx(NOW) of the position misregistration amount of the laser beam irradiation, the color misregistration can be suppressed.

It is noted that at first image formation, a value for Dx(PREV) does not exist. Thereby, in the present embodiment, before executing the image formation, a measurement image is formed and an actual measurement value of the color misregistration amount is measured using the detection patch. The actual measurement value for the color misregistration amount is used as Dx(PREV) at the first image formation. It is noted that how to obtain Dx(PREV) at the first image formation is not limited to this example. It is obtained by an arbitrary method.

As shown in the expression (5), the prediction value Dx depends on the variation amount of the scanner temperature Tscn and the variation amount of the developing temperature Tdev. Further, in this embodiment, in a case where the difference between the scanner temperature Tscn and the environmental temperature Tenv is larger than the threshold Tthrsh, ΔTscn is set to 0 (zero). Thereby, in this case, the prediction value Dx depends on the variation amount of the developing temperature Tdev, but it does not depend on the value of the scanner temperature Tscn.

The temperature threshold Tthrsh and the correction coefficients Kscn and Kdev shown in the flowchart in FIG. 9 can previously be obtained by measuring the color misregistration amount D on the image and the detected temperature when a consecutive printing operation is performed in a design stage or when a printing operation is performed after leaving the apparatus in a standby state. Further, by performing the similar measurement to a plurality of the image forming apparatuses 100 to average data, a coefficient which is unique to a product can be obtained.

FIG. 10 is a graph showing an experiment result in which the prediction value calculated using the flowchart in FIG. 9 is compared with the actual measurement value of the color misregistration amount D. In FIG. 10, a lateral axis represents the scanner temperature Tscn and a longitudinal axis represents the color misregistration amount. Also, a solid line represents an actual measurement value and a broken line represents the prediction value calculated using the flow.

As shown in the graph in FIG. 10, in a section from Ty1 to Ty2 where the scanner temperature Tscn is about 27° C. to 38° C., the scanner temperature is almost in proportional relation with the color misregistration amount D. This is because, in this section, difference of the measurement value between the scanner temperature Tscn(NOW) and the environmental temperature Tenv(NOW) is less than the threshold Tthrsh. On the other hand, in a section from Ty2 to Ty3 where the scanner temperature Tscn is about 38° C. to 43° C., even if the scanner temperature changes, the color misregistration amount does not change. In this section, the difference of the measurement value between the scanner temperature Tscn(NOW) and the environmental temperature Tenv(NOW) is equal to or more than the threshold Tthrsh.

Relation between the prediction value and the actual measurement value shown in FIG. 10 indicates that the prediction value sufficiently follows the actual measurement value by using the prediction flow in the present embodiment. As mentioned, by performing the color misregistration correction based on the calculated prediction value, the color misregistration can be suppressed without causing downtime accompanied by suppressing the color misregistration.

It is noted that, in the present embodiment, in a case where the difference between the scanner temperature Tscn and the environmental temperature Tenv is larger than the threshold Tthrsh, ΔTscn is set to 0 (zero). However, ΔTscn is not necessarily set to 0 (zero). For example, by calculating Δ'Tscn, which is a conversion value in which its absolute value is converted to a value smaller than the absolute value of ΔTscn and using Δ'Tscn instead of ΔTscn, the prediction value Dx(NOW) can be obtained. Even in this case, by reflecting the change of the inclination of the graph in FIG. 6, the prediction value Dx(NOW) of the color misregistration amount D can be calculated with more accuracy.

Further, in a case where the difference between the scanner temperature Tscn and the environmental temperature Tenv is larger than the threshold Tthrsh, it is possible to correct Kscn which is the coefficient of Tscn such that the coefficient becomes smaller than the value of Tscn when the difference is the threshold Tthrsh or below. Further, it may be configured such that as the difference becomes larger than the threshold Tthrsh, Kscn which is the coefficient of Tscn may be reduced. Further, by employing an arbitrary method such that as the difference becomes larger than the threshold Tthrsh, the value obtained by Kscn*ΔTscn is reduced, the prediction value Dx(NOW) can be calculated.

Further, the color misregistration amount determined based on the temperature information obtained by each temperature sensor is the prediction amount. Thereby, an error between the prediction value of the color misregistration amount and the actual measurement value of the color misregistration amount may be accumulated, which may cause the color misregistration exceeding an allowable range. Then, at predetermined timing, the CPU 501 causes the image forming section 101 to form the detection patch 51, causes the sensors 46, 47, and 48 to detect the detection patch 51 and corrects, based on the detection result, the image forming position of the rest of the colors which is different from the reference color. It is noted that, for example, the predetermined timing corresponds to timing at which the variation amount of the scanner temperature Tscn detected by the scanner temperature sensor 450 exceeds the predetermined amount after the image forming position of the rest of the colors is corrected based on the previous detection result of the detection patch 51.

It means that the CPU 501 corrects the color misregistration based on the detection result of the color misregistration amount (actual measurement value) for each predetermined timing. At timing other than the predetermined timing, the CPU 501 corrects the color misregistration based on the color misregistration amount (prediction value) based on the detected temperature of the scanner temperature sensor 450.

It is noted that, in a case where the color misregistration amount of each color of the measurement image is measured using the color misregistration detection patch 51, the CPU 501 sets the color misregistration prediction value Dx(PREV) to 0 (zero) to obtain the scanner temperature Tscn and the developing temperature of each color. Then, the CPU 501 updates the scanner temperature Tscn(PREV) and the developing temperature Tdev(PREV) based on the obtained temperature information.

According to the first embodiment, the image forming apparatus 100 can suppress frequency at which the detection patch 51 is formed while correcting the color misregistration with high accuracy.

Second Embodiment

In the second embodiment, a heat generating body for suppressing humidity rise near the photosensitive drum is provided in the image forming apparatus 100 shown in the first embodiment. The heat generating body is provided outside the optical box 401. In particular, drum heaters 601 and 602 are provided inside the intermediate transfer unit. It is noted that, the configuration other than the drum heaters 601 and 602 is the same as that shown in FIGS. 2A to 2D so that a detailed description is omitted.

Figure 11:
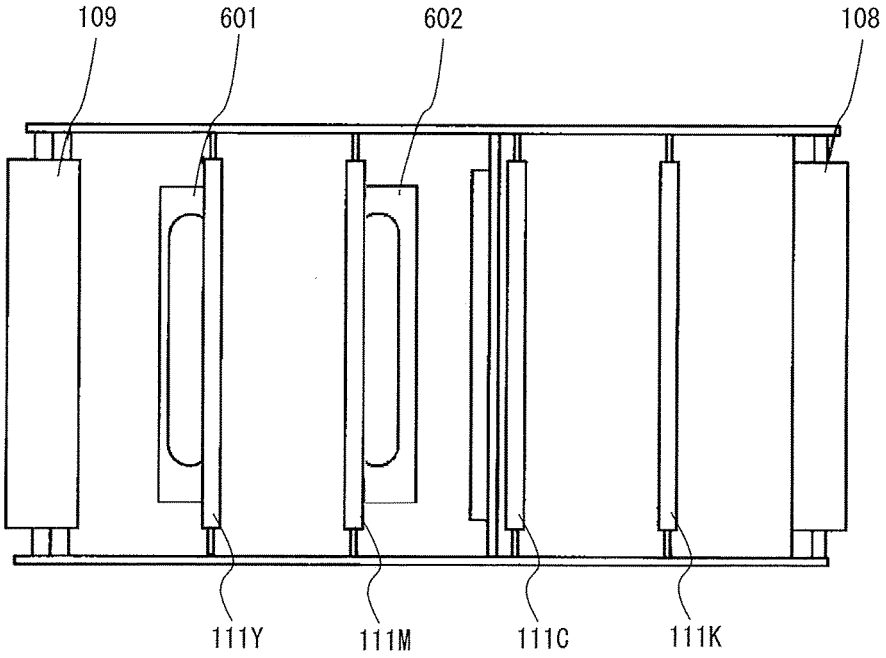
FIG. 11 is a top view of an intermediate transfer unit.

FIG. 11 is a top view of an intermediate transfer unit formed by the intermediate transfer belt 107, the drive roller 108, the driven roller 109, and the primary transfer devices 111Y, 111M, 111C, and 111K shown in FIG. 1. It is noted, for explanation, that a state in which the intermediate transfer belt 107 is removed is shown in FIG. 11.

In a case where the temperature near the photosensitive drum rises by the drum heater 601, rise of relative humidity near the photosensitive drum can be suppressed as a result, which enables to suppress defective images caused under a high humidity environment.

However, when operating the drum heaters 601 and 602, the difference between the scanner temperature Tscn which is the temperature in the main body and the environment temperature Tenv becomes large as compared to a case when not operating the drum heaters 601 and 601.

As a result, in a case where the temperature threshold Tthrsh in the first embodiment is employed in the second embodiment as it is, regardless of the fact that the color misregistration amount D is in proportion with the scanner temperature, the difference between both sensors sometimes becomes larger than the temperature threshold Tthrsh.

Then, in the second embodiment, when operating the drum heaters 601 and 602, the temperature threshold is set to temperature threshold Tthrsh' which is higher than the temperature threshold Tthrsh when not operating the drum heaters 601 and 602. Due to this, in accordance with the variation of the temperature threshold Tthrsh by operating the drum heaters 601 and 602 and its resultant variation of the boundary temperature Ta, the prediction of the color misregistration amount D can be performed, which enables to improve the prediction accuracy.

Thereby, in accordance with the second embodiment, even in a case where the drum heaters 601 and 602 heat inside of the image forming apparatus, the color misregistration can be corrected with high accuracy. As mentioned, in accordance with each embodiment, it is possible to improve the prediction accuracy of the color misregistration. Further, the processing as described in each embodiment is realized by, for example, MPU (Micro-Processing Unit), ASIC (Application Specific Integrated Circuit), SoC (System-on-a-Chip) and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-110825, filed Jun. 2, 2016, which is hereby incorporated by reference herein in its entirety.

What is claimed is:

1. An image forming apparatus comprising:

an image forming unit including a plurality of photosensitive members, an exposure device to expose each of the plurality of photosensitive members to form electrostatic latent images, and a developing device to develop the electrostatic latent images on the photosensitive member, the image forming unit configured to form a plurality images, each having a different color;

a transfer member onto which the plurality of images formed by the image forming unit are transferred;

a first temperature detection unit provided on a circuit board of the exposure device and configured to detect a first temperature of the exposure device, the circuit board controlling a light source of the exposure device;

a second temperature detection unit configured to detect a second temperature;

a third temperature detection unit configured to detect a third temperature, wherein a distance between the third temperature detection unit and the first temperature detection unit is longer than a distance between the second temperature detection unit and the first temperature detection unit;

a detection unit configured to detect a patch image formed on the transfer member, the patch image being used for detecting color misregistration;

a controller configured to control the image forming unit to form, on the transfer member, a plurality of patch images, each having a different color, control the detection unit to detect an amount of color misregistration, related to a relative position of a patch image having a reference color among the plurality of patch images and a patch image having another color among the plurality of patch images; and a correction unit configured to correct an image write start timing of the other color different from the reference color based on the amount of color misregistration, the first temperature detected by the first temperature detection unit, and the second temperature detected by the second temperature detection unit, wherein the correction unit, in a case where a difference between the first temperature and the third temperature is greater than a threshold, corrects the image write start timing based on the amount of color misregistration and the second temperature without the first temperature.

2. The image forming apparatus according to claim 1, wherein the correction unit, in a case where the difference between the first temperature and the third temperature is less than the threshold, corrects the image write start timing based on the amount of color misregistration, the first temperature, and the second temperature.

3. The image forming apparatus according to claim 1, wherein the correction unit corrects the image write start timing based on the amount of color misregistration, a difference between the first temperature and a previous first temperature detected by the first temperature detection unit, and a difference between the second temperature and a previous second temperature detected by the second temperature detection unit, wherein the correction unit, in a case where the difference between the first temperature and the third temperature is greater than the threshold, corrects the image write start timing based on the amount of color misregistration and the difference between the second temperature and the previous second temperature.

4. The image forming apparatus according to claim 1, wherein the circuit board is provided outside the exposure device.

5. The image forming apparatus according to claim 1, wherein the second temperature detection unit is arranged at the developing device.

6. An image forming apparatus comprising:

a first image forming unit including a first photosensitive member, a first exposure device to expose the first photosensitive member to form a first electrostatic latent image, and a first developing device to develop the first electrostatic latent image on the first photosensitive member, the first image forming unit configured to form a first image having a first color;

a second image forming unit including a second photosensitive member, a second exposure device to expose the second photosensitive member to form a second electrostatic latent image, and second developing device to develop the first electrostatic latent image on the second photosensitive member, the second image forming unit configured to form a second image having a second color different from the first color;

a transfer member onto which the first image and the second image are transferred;

a first temperature detection unit provided on a circuit board of the second exposure device and configured to detect a first temperature of the second exposure device, the circuit board controlling a light source of the second exposure device;

a second temperature detection unit configured to detect a second temperature;

a third temperature detection unit configured to detect a third temperature, wherein a distance between the third temperature detection unit and the first temperature detection unit is longer than a distance between the second temperature detection unit and the first temperature detection unit, a detection unit configured to detect a patch image formed on the transfer member, the patch image being used for detecting color misregistration;

a controller configured to control the first image forming unit and the second forming unit to form, on the transfer member, a plurality of patch images including a first patch image having the first color and a second patch image having the second color, and control the detection unit to detect an amount of color misregistration related to a relative position of the first patch image and the second patch image; and a correction unit configured to correct an image write start timing of the second image based on the amount of color misregistration, the first temperature detected by the first temperature detection unit, and the second temperature detected by the second temperature detection unit, wherein the correction unit, in a case where a difference between the first temperature and the third temperature is greater than a threshold, corrects the image write start timing based on the amount of color misregistration and the second temperature without the first temperature.

7. The image forming apparatus according to claim 6, wherein the correction unit, in a case where the difference between the first temperature and the third temperature is less than the threshold, corrects the image write start timing based on the amount of color misregistration, the first temperature, and the second temperature.

8. The image forming apparatus according to claim 6, wherein the correction unit corrects the image write start timing based on the amount of color misregistration, a difference between the first temperature and a previous first temperature detected by the first temperature detection unit, and a difference between the second temperature and a previous second temperature detected by the second temperature detection unit, wherein the correction unit, in a case where the difference between the first temperature and the third temperature is greater than the threshold, corrects the image write start timing based on the amount of color misregistration and the difference between the second temperature and the previous second temperature.

9. The image forming apparatus according to claim 6, wherein the circuit board is provided outside the second exposure device.

10. The image forming apparatus according to claim 6, wherein the second temperature detection unit is arranged at the second developing device.

* * * * *